US006224922B1

(12) United States Patent
Fonte

(10) Patent No.: US 6,224,922 B1
(45) Date of Patent: May 1, 2001

(54) DRINK COLORIZER

(76) Inventor: Mark J. Fonte, 193 Sprain Rd., Scarsdale, NY (US) 10583

( * ) Notice: Subject to any disclaimer, the term of this patent is extended or adjusted under 35 U.S.C. 154(b) by 0 days.

(21) Appl. No.: 09/464,889

(22) Filed: Dec. 16, 1999

(51) Int. Cl.[7] ..... B65D 85/72; B65D 25/06

(52) U.S. Cl. ..... 426/115; 426/250; 222/144; 222/153.1; 222/520; 206/221

(58) Field of Search ..... 426/115, 112, 426/120, 116, 250; 222/144, 144.5, 520, 519, 132, 153.14, 541.6, 541.9, 453.1; 206/221

(56) References Cited

U.S. PATENT DOCUMENTS

| | | | | |
|---|---|---|---|---|
| 3,110,423 | * | 11/1963 | Hegedic et al. | 222/135 |
| 3,321,097 | * | 5/1967 | Solowey | 206/221 |
| 3,743,520 | * | 7/1973 | Croner | 426/87 |
| 4,024,952 | * | 5/1977 | Leitz | 206/221 |
| 4,727,985 | * | 3/1988 | McNeirney et al. | 206/221 |
| 4,785,931 | * | 11/1988 | Weir et al. | 206/222 |
| 5,035,320 | * | 7/1991 | Plone | 206/219 |
| 5,125,534 | * | 6/1992 | Rose et al. | 222/54 |
| 5,373,937 | * | 12/1994 | Lamboy | 206/221 |
| 5,431,276 | * | 7/1995 | Lialin | 206/222 |
| 5,529,179 | * | 6/1996 | Hanson | 206/119 |
| 5,688,545 | * | 11/1997 | Sanders | 426/120 |
| 5,772,017 | * | 6/1998 | Kang | 206/222 |

FOREIGN PATENT DOCUMENTS

| | | | | |
|---|---|---|---|---|
| 55-015770 | * | 2/1980 | (JP) | A23L/2/00 |

* cited by examiner

*Primary Examiner*—Milton Cano
*Assistant Examiner*—Sherry A. Dauerman
(74) *Attorney, Agent, or Firm*—Carl C. Kling

(57) ABSTRACT

The invention is a specialty beverage container with a multiple colorant reservoir built into the cap 4. The colorant reservoir has a number of colorant chambers respectively for the colorants, such as primary colors red, yellow and blue, or others. The colorant reservoir 5 has a number of colorant chambers arrayed much like the sections of an orange, opening into a central cylindrical tube 7. Central cylindrical tube 7 is open into the main chamber 3 of the beverage container (bottle 1). The consumer purchases a bottle 1 filled with a neutral drink and with a colorizer cap 4. The consumer then proceeds to unlock the colorizer cap 4, select a color, and add colorant or colorants to achieve the desired hue and intensity. The consumer may then remove the colorant valve mechanism (or the entire colorizer cap) and drinks the beverage colored to his specifications.

6 Claims, 1 Drawing Sheet

DRINK COLORIZER

BACKGROUND OF THE INVENTION

1. Field of the Invention

This invention relates to a drink colorizer, and particularly to a self-contained drink colorizing system having a selective color-dispensing multiple reservoir and a rotatably and linearly movable lockable selecting and dispensing valve.

2. Description of the Related Art

Coloring of drinks is known. Various colored drinks, and various colored drink mixes, are widely marketed There are, however, no self-contained drink coloring systems having a self-contained selective color-dispensing multiple reservoir.

BRIEF SUMMARY OF THE INVENTION

The invention is a specialty beverage container with a multiple colorant reservoir built into the cap. The colorant reservoir has a number of colorant chambers, much like the sections of an orange, opening into a central cylindrical tube, which is open into the main chamber of the beverage container (bottle). The consumer purchases a bottle filled with a neutral drink and with a colorizer cap. The consumer then proceeds to unlock the colorizer cap, select a colorant, and add colorant or colorants to achieve the desired color. The consumer may then discard the colorant valve mechanism (or the entire colorizer cap) and drink the beverage colored to his specifications.

The central cylinder has controlled inner diameter, into which each of the several colorant chambers opens through a small valve opening. All the valve openings are normally sealed by a colorant-selection valve tube which closely fits the controlled inner diameter. The valve tube is sealed at the top, open at the bottom, and has a single opening aligned for connecting to the individual colorant chambers of the reservoir when pulled up into operating position. When the valve tube is pushed down, into its normal position for shipping, it seals all the colorant chambers. It is locked into sealing position by a pull tab, which serves both as a lock and as a tamper-indicator. When unlocked, the valve tube is pulled up into operating position, and rotated so that the valve tube opening aligns with a selected colorant chamber. The valve connection is sufficiently restricted to feed colorant slowly, drop by drop, so that the colorization may be easily controlled. The valve may be rotated again and again, to align with additional colorant chambers, to provide the selected color.

The object of the invention is to make an inexpensive, attractive, single-use self-contained colorizer for a beverage.

A feature of the invention is the placement of multiple colorant chambers in a colorizer cap, which colorizer cap has a locked colorant-selection valve which also serves as a permanent seal until unlocked.

An advantage of the invention is that it allows easy selection of the exact color desired.

Another advantage is its educational value in showing how colors are combined to form additional colors. Red and yellow, for example, yield orange.

Still another advantage is that the colorant chambers are typically sealed at atmospheric pressures, and may have a shelf life span great enough to permit the bottler to keep a significant inventory of colorizer caps prior to filling the bottles with the beverage liquid. The beverage liquid, which may vary in pressure as a function of temperature, may be carbonated under slight pressure, or may be compressed by being squeezed, without affecting the colorants which are separately sealed.

DETAILED DESCRIPTION OF THE INVENTION

DESCRIPTION OF A PREFERRED EMBODIMENT

Figure 1:
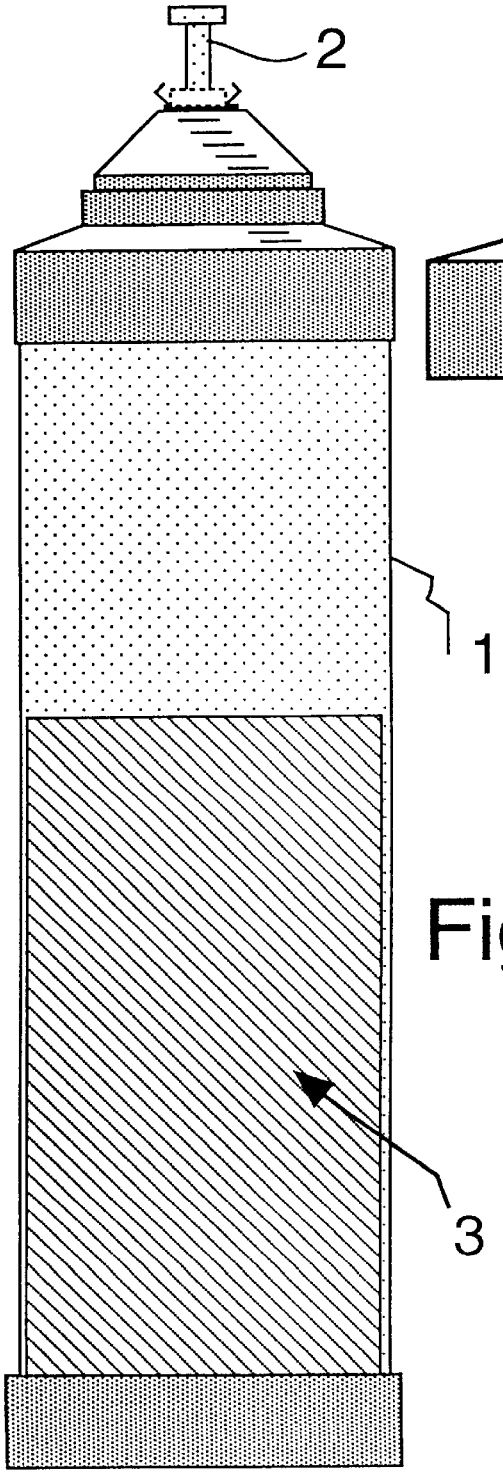
FIG. 1 is a side elevation view of the invention, seal broken, in operation with colorant already dispensed into the beverage liquid.
Figure 2:
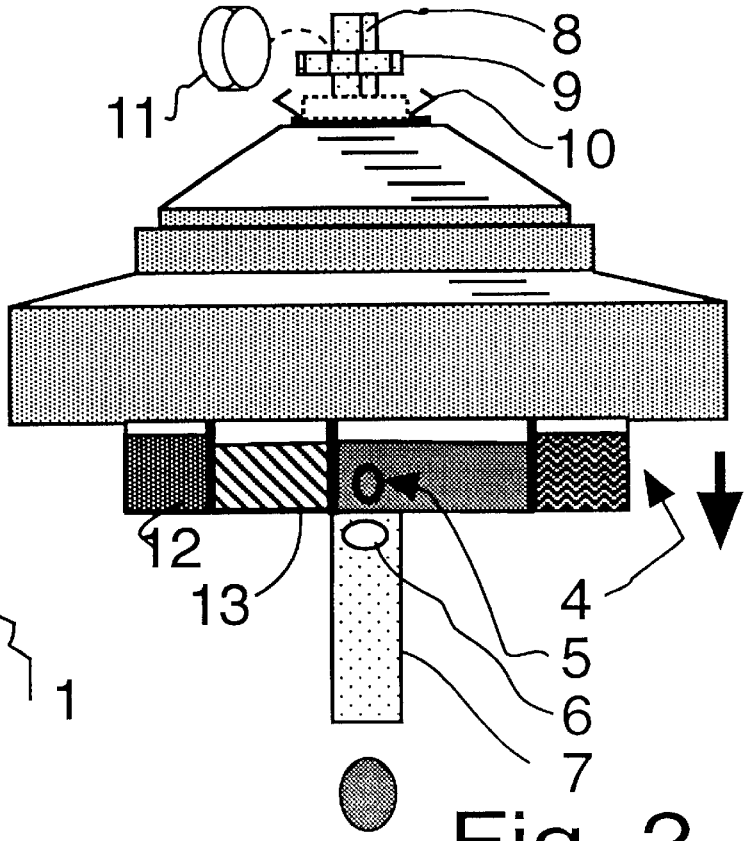
FIG. 2 is an enlarged side elevation view of the colorant dispenser subassembly of the invention.
Figure 3:
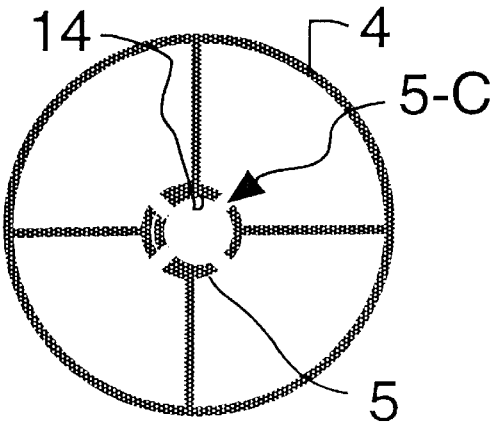
FIG. 3 is a plan view of the colorant reservoir of the invention.

FIGS. 1–3 show details of the invention.

FIG. 1 is a perspective view of the beverage colorizer system of the invention. Bottle 1 holds potable beverage liquid, preferably club soda or the like. Bottle 1 has been shipped to the consumer with liquid sealed inside by colorizer seal valve 2.

FIG. 2 has a seal which is shown broken, with colorizer seal valve 2 raised to operating position, ready to dispense one or more selected colorants into the beverage liquid 3 from colorant reservoir chamber cap 4. The colorant chambers are shown filled with a first colorant which may be red, which is beginning to dispense red colorant liquid from the colorant chamber into the beverage liquid 3, made possible when via-openings 5, 6 line up. Via-openings 5 are obscured in FIG. 2. The central cylinder 5-C of the colorant reservoir cap 4 is lined up with via-opening 6 in the vertical mode, by the pulling up of colorizer valve inner tube 7 so that valve opening 6 can match a valve via-opening 5 in central cylinder 5-C. Colorant in the selected chamber drains from the colorant chamber through the related via-opening 5-C, through via-opening 6 and down valve tube 7 to drop into the beverage liquid 3.

Cap lock 10 with straw cap 11 completes the system.

FIG. 2 is a side elevation view of the colorant reservoir cap 4, showing liquid levels in some of the chambers 12 and 13 of the colorant reservoir. Via-openings 5 (obscured in FIG. 2) selectively align with via-opening 6 in valve inner tube 7 to dispense colorant as shown by the drop coming out of valve inner tube 7. Choice of colorant is by rotating valve inner tube 7 which extends in a short drinking straw portion 8 above the cap 4. Wheel 9 is affixed to rotating valve inner tube 7 so as to provide easy rotation to select the particular desired colorant chamber.

FIG. 3 shows the colorant reservoir cap 4, which may have the inner cylinder 14 threaded so that rotation of the valve stem controlled by threads provides a more certain alignment of via-openings 5 (obscured in FIG. 2) for selection of the individual colorant chambers 12, 13. Rotation of the colorizer seal valve 6–9 opens a channel for colorant from the selected reservoir 5 chamber (red selected).

In operation, the rainbow drink permits the consumer to experiment with colorization of the individual drink, by unsealing the drink, selecting one or a combination of colorants, watching the flow of colorant drops until the desired hue and intensity is achieved, then removing the cap for pouring or drinking from the bottle. While the invention has been shown and described with respect to a drink colorizer, it will be obvious to those skilled in the art that the same colorizer may be used for other products.

What is claimed is:

1. A speciality beverage colorizer system, comprising: a main chamber filled with a beverage liquid having a neutral hue, said system further comprising:

a) a cap including a number of integral colorant chambers, each fillable with a different colorant, said colorant chambers forming a multiple colorant reservoir having a central stem enclosure for dispensing colorant, each colorant chamber having a valve via-opening aperture through said stem enclosure, wherein the stem enclosure accommodates a hollow stem having a movable via-opening that can be selectively moved to be in fluid communication with one of said colorant chambers, and said hollow stem having an outlet opening into the main chamber;

b) a rotatably and linearly movable dispensing valve, wherein the movable via-opening in said stem is positioned to be in selective alignment with one of each of the valve via-opening apertures in the stem enclosure, said hollow stem of the dispensing valve forming an inner tube that fits tightly within the stem enclosure and has the outlet opening into the main chamber of the beverage container;

whereby the multiple colorant reservoir of said cap is capable of selectively dispensing colorant to provide a desired hue to said beverage liquid enclosed within the main chamber.

2. A colorizer system to achieve the desired hue and intensity of a beverage liquid according to claim 1, wherein the stem of said dispensing valve has a threaded portion mating with a complementary threaded portion within said cap, the threaded portions arranged to present the via-opening within the stem of said dispensing valve to said colorant chamber via-openings within said cap by vertically repositioning the stem of said dispensing valve.

3. A colorizer subsystem arranged to be attached to a specialty beverage colorizer system main chamber filled with a beverage liquid having a neutral hue, wherein the combination of the colorizer system and subsystem provide a desired hue and intensity for the beverage liquid enclosed within the main chamber, the subsystem comprising:

a) a colorizer subsystem cap for attaching the main chamber of the specialty beverage colorizer system, said cap including a number of integral colorant chambers fillable with different edible colorants, wherein the colorant chambers form an outer cylinder and a central cylinder wall therein, each colorant chamber having an aperture via-opening to provide access into the central cylinder, wherein the aperture via-opening of each colorant chamber provides a valve opening through said central cylinder wall;

b) a rotatably and linearly movable selective dispensing valve comprising a valve stem positioned within an inner portion of the central cylinder wall, the valve stem having a via-opening selectively positioned to be in fluid communication with each of the valve via-openings in the colorant chambers and with an outlet opening positioned to be in communication with the main chamber of the system and having the subsystem attached to the main chamber, the valve stem lockable in a vertical alignment to seal the main chamber and all the colorant chambers, the valve stem having an operative vertical alignment opening to dispense into the main chamber and in the open position to be in selective alignment with each of the valve via-openings in said colorant chambers, the stem of said selective dispensing valve arranged for snug fit within said central cylinder wall, wherein the outlet opening is in communication with the main chamber of the beverage container; and said valve stem has a threaded mating portion with a complimentary threaded portion of said cap, arranged to present the via-opening of said valve stem to said valve via-openings within the colorant chambers of said cap by vertically repositioning and selectively rotating the valve stem to different positions.

4. A colorizer subsystem according to claim 3, wherein said valve stem is placed in the pushed down position for shipping, sealing the main chamber and all colorant chambers, the valve stem locked in the pushed down position by a pull tab that provides a tamper-indicator lock.

5. A colorizer subsystem according to claim 4, wherein said valve stem is placed in an extended position to serve as a drinking straw, wherein the main chamber is unsealed while all the colorant chambers are sealed when the straw is in the extended position.

6. A colorizer subsystem according to claim 5, wherein said valve stem is placed in position and is equipped with a pull tab tamper-indicat the drinking straw.

* * * * *